US009404494B2

(12) United States Patent
Joistgen

(10) Patent No.: US 9,404,494 B2
(45) Date of Patent: Aug. 2, 2016

(54) SCREW PUMP HAVING AN INTEGRATED PRESSURE LIMITING VALVE

(75) Inventor: Walter Joistgen, Cologne (DE)

(73) Assignee: Robert Bosch GmbH, Stuttgart (DE)

( * ) Notice: Subject to any disclaimer, the term of this patent is extended or adjusted under 35 U.S.C. 154(b) by 1029 days.

(21) Appl. No.: 13/512,138

(22) PCT Filed: Sep. 15, 2010

(86) PCT No.: PCT/EP2010/005657
§ 371 (c)(1),
(2), (4) Date: Sep. 12, 2012

(87) PCT Pub. No.: WO2011/063870
PCT Pub. Date: Jun. 3, 2011

(65) Prior Publication Data

US 2013/0022458 A1 Jan. 24, 2013

(30) Foreign Application Priority Data

Nov. 28, 2009 (DE) ..... 10 2009 056 218

(51) Int. Cl.
*F04C 2/16* (2006.01)
*F01C 21/02* (2006.01)
*F01C 21/10* (2006.01)
*F04C 14/24* (2006.01)

(52) U.S. Cl.
CPC ..... *F04C 2/165* (2013.01); *F01C 21/02* (2013.01); *F01C 21/10* (2013.01); *F04C 14/24* (2013.01); *F04C 2230/60* (2013.01)

(58) Field of Classification Search
CPC ..... F01C 21/02; F01C 21/10; F04C 2/165; F04C 14/24; F04C 2230/60
USPC ..... 415/182.1, 213.1, 215.1; 417/120, 192, 417/307
See application file for complete search history.

(56) References Cited

U.S. PATENT DOCUMENTS

| | | | | |
|---|---|---|---|---|
| 3,759,636 | A * | 9/1973 | Schaefer et al. | 417/281 |
| 6,345,959 | B1 * | 2/2002 | Spurry | 417/297 |
| 2002/0136643 | A1 * | 9/2002 | Eberl | 417/248 |
| 2002/0146328 | A1 * | 10/2002 | Yokomachi et al. | 417/307 |
| 2005/0163623 | A1 * | 7/2005 | Okada | 417/44.2 |

FOREIGN PATENT DOCUMENTS

| | | |
|---|---|---|
| GB | 2 353 371 A | 2/2001 |
| GB | 2 367 095 A | 3/2002 |
| WO | 03/006348 A1 | 1/2003 |

* cited by examiner

*Primary Examiner* — Dwayne J White
*Assistant Examiner* — Justin Seabe
(74) *Attorney, Agent, or Firm* — Maginot, Moore & Beck LLP

(57) ABSTRACT

A screw pump includes a pump housing on which a flange section for installing the pump is formed. The screw pump further includes an integrated pressure limiting valve. The pressure limiting valve in the flange section of the pump housing is installed in the pump housing.

8 Claims, 1 Drawing Sheet

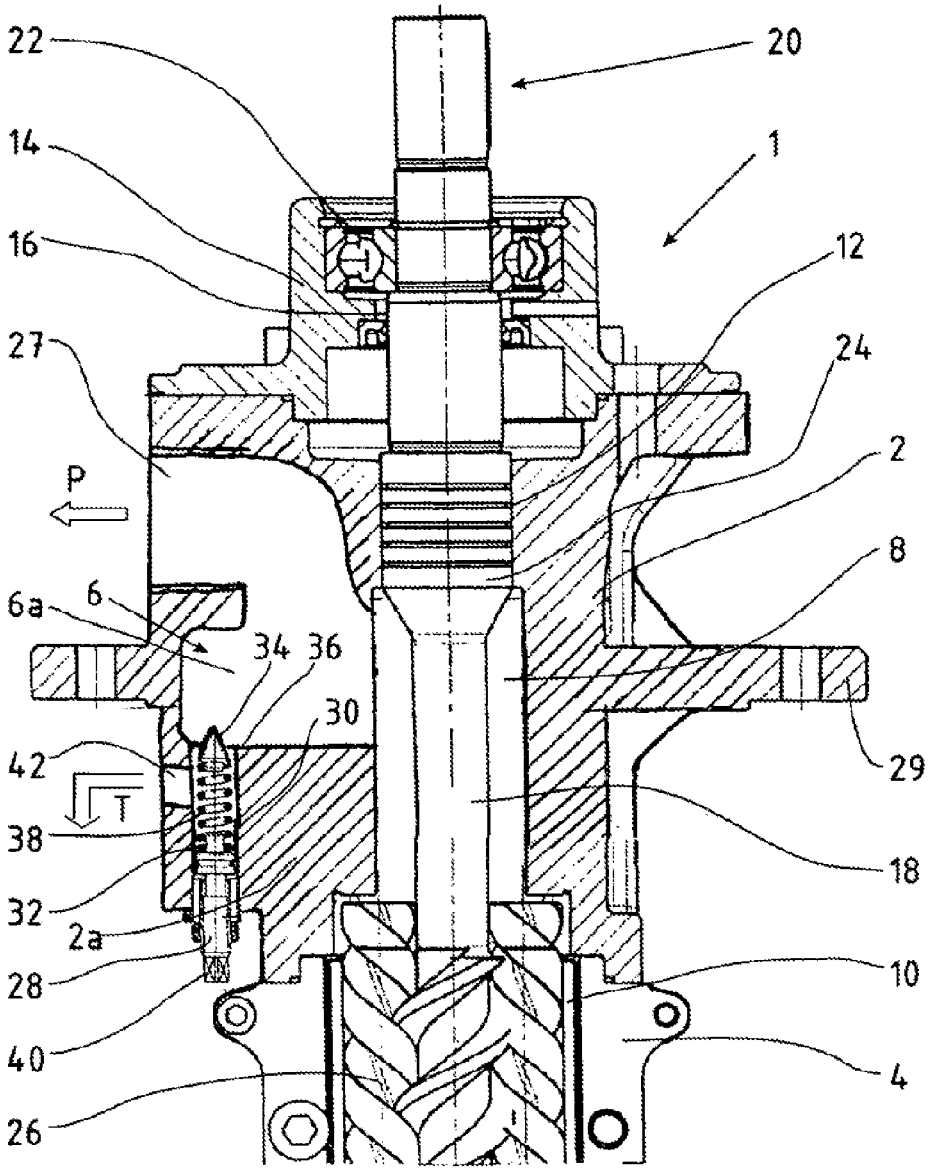
22
20
14
1
16
12
27
24
P
2
8
6a
6
34
36
30
29
42
T
38
18
32
2a
28
10
40
4
26

SCREW PUMP HAVING AN INTEGRATED PRESSURE LIMITING VALVE

This application is a 35 U.S.C. §371 National Stage Application of PCT/EP2010/005657, filed on Sep. 15, 2010, which claims the benefit of priority to Serial No. DE 10 2009 056 218.4, filed on Nov. 28, 2009 in Germany, the disclosures of which are incorporated herein by reference in their entirety.

The present disclosure relates to a screw pump having an integrated pressure limiting valve.

Screw pumps are generally self-priming positive displacement pumps preferably suitable for the low pressure range and are used to pump fluids in the form of supply and discharge pumps, for pumping heavy and light heating oils and for all lubricating fluids, used and residual oils and grease. Screw pumps can furthermore be used as lubricating, sealing, control, hydraulic, cooling and refrigerating oil pumps, and as fuel pumps for engines.

By way of example, the prior art has disclosed a screw pump of this kind which has three screws, which are mounted parallel to one another in a pump housing. Here, the pump housing forms a screw chamber, into which the screw or shaft sections of the three screws project and which has a fluid connection to a pressure chamber. Also formed in the pump housing is an inlet duct, which opens into the screw chamber at one axial end thereof, and an outlet duct, which forms the pressure chamber at another axial end, opening into said chamber.

A pressure limiting valve is inserted into the pump housing or the housing wall thereof, parallel to the screw chamber, extending coaxially with the screws and opening into the pressure outlet duct. The pressure limiting valve furthermore has a connection to the inlet duct formed in the pump housing.

Accordingly, if the pressure in the pressure outlet duct exceeds a predetermined value, the pressure limiting valve opens and relieves the excess pressure to the suction side of the screw pump. This prevents pressure overloading of the pump. However, the integration of the pressure limiting valve into the pump housing makes it necessary to reinforce the pump housing or the housing wall thereof at the envisaged location of installation in order to be able to create an accommodation space for the pressure limiting valve. This requires an increase in the external dimensions of the pump housing, and the pump also becomes heavier overall due to the additional cast material on the pump housing.

Given this known prior art, it is the object of the present disclosure to provide a screw pump having an integrated pressure limiting valve, the external dimensions of which can be kept compact and which is of lighter construction than the prior art.

This object is achieved by a screw pump having the features set forth below. Further advantageous embodiments of the disclosure are also set forth below.

The basic concept of the disclosure is based on using already existing accumulations of material on the pump housing, which are required for the operation and/or installation of the pump, for the installation of an integrated pressure limiting valve. According to the disclosure, therefore, provision is made for the pressure limiting valve to be installed in the flange section of the pump housing, which already has an accumulation of material in the pump housing or on the housing wall by virtue of the function thereof. In this way, there is no need to provide an additional cast lug on the pump housing, and therefore the external dimensions of the pump housing do not increase relative to a screw pump without the pressure limiting valve.

Moreover, there is little or no increase in the weight of a screw pump having a pressure limiting valve integrated in this way.

In the screw pump according to the present disclosure, the pressure chamber is preferably likewise formed in the flange section of the pump housing, wherein the pressure limiting valve opens directly into the pressure chamber. In this way, the wall thickness of the pump housing remains great enough in the region of the pressure chamber to withstand the pressure that may be expected in the pressure chamber, without the need to make any additional wall reinforcements here.

It is furthermore advantageous to form the flange plate of the pump on the pump housing at a location such that the flange plate surrounds the pressure chamber like a belt. In this way, the housing wall is additionally reinforced in the region of the pressure chamber.

BRIEF DESCRIPTION OF THE DRAWING

FIG. 1 is a cross-sectional view of the pump housing according to a preferred embodiment of the disclosure.

DETAILED DESCRIPTION

The disclosure is explained in greater detail below with reference to a preferred illustrative embodiment with reference to the single accompanying figure. This figure shows a longitudinal section through the housing of a screw pump according to the disclosure with an inserted screw and an installed (integrated) pressure limiting valve.

The pump housing 1 of the screw pump according to the preferred illustrative embodiment of the disclosure consists of a flange section 2 for mounting the pump on a component (not shown specifically) and a screw housing section 4 which represents a separate housing part from the flange section 2 and is screwed, caulked or riveted to the flange section 2.

Formed in the flange section 2 is a pressure chamber 6, which is connected to a screw chamber 10 within the screw housing section 4 by a connecting bore 8. Moreover, an inlet bore 12 is formed in the flange section 2 as an axial extension of the connecting bore 8, said inlet bore likewise opening into the pressure chamber 6 and leading to a flange-type outer side of the flange section 2, said outer side lying opposite the screw housing section 4. A pump cover 14 is screwed onto this outer side, and a through bore 16 is likewise formed in this pump cover, said bore being aligned axially with respect to the connecting bore 8 and inlet bore 12 of the flange section 2.

The shank 18 of a screw 20 is inserted into the bores 8, 12, 16 in such a way that it is rotatably supported in the through bore 16 of the pump cover 14 by means of a ball bearing or rolling contact bearing 22. In the region of the inlet bore 12 of the flange section 2, the screw shank 18 is formed with a sealing section 24, which is in sealing sliding engagement with the inlet bore 12 of the flange section 2. Finally, the screw 20 forms a helical section 26, which is accommodated in the screw chamber 10 of the screw housing section 4. The pressure chamber 6 in the flange section 2 is formed non-centrally with respect to the screw shank 18, i.e. the pressure chamber 6 forms a radially projecting section **6*a* relative to the screw shank 18 and to the connecting bore 8 formed in the flange section 2. Opening into this radially offset or projecting section 6*a* is an outlet bore 27 of the screw pump. Moreover, the flange section 2 has an integrally formed annular flange plate 29, which surrounds the pressure chamber 6 and, in the process, reinforces the housing wall of the flange section 2**.

A pressure limiting valve 28 is inserted into the flange section 2, parallel to the screw shank 18, at the level of the connecting bore 8 and opens into the radially offset or projecting section 6*a* of the pressure chamber 6. More specifically, the flange section 2 forms in this region an accumulation of material 2*a* in which the pressure chamber 6 is formed on the inside and which is suitable for the formation of a bore 30 for the pressure limiting valve coaxially with the connecting bore 8 of the flange section 2. Consequently, the pressure limiting valve 28 is positioned in a region between the screw housing section 4 and the flange plate 29, approximately at the level of the connecting bore 8 and coaxially with the screw shank 18.

In this arrangement, the pressure limiting valve 28 consists of a valve element 32 in the form of a plunger, the plunger tip 34 of which is seated in a sealing manner on a valve seat 36, which is formed in the pump housing 1, i.e. in the flange section 2. In this case, the valve element 32 is preloaded onto the valve seat 36 by means of a spring 38, the preloading force of which can be adjusted by means of an adjusting screw 40, which is likewise screwed into the flange section 2 of the pump housing 1. A drain bore 42 bored into the flange section 2 substantially perpendicularly to the pressure limiting valve 28 is provided underneath the valve seat 32 and is connected to a fluid tank (not shown specifically). As soon as a pressure set by means of the preloading spring 38 is exceeded within the pressure chamber 6, the pressure limiting valve 28 opens and relieves the excess pressure directly into the fluid tank.

Finally, it should be noted that the position and alignment of the pressure limiting valve 28 is not limited to the illustrative embodiment described above. On the contrary, the pressure limiting valve 28 could also be inserted into the flange section 2 in a radial direction relative to the connecting bore 8, in which case the valve plunger 32 of the pressure limiting valve 28 opens or closes a pressure relief bore between the pressure chamber 6 and a tank port, said relief bore running parallel to the connecting bore 8. It is also conceivable to insert the pressure limiting valve 28 into the flange section 2 above the flange plate 29, i.e. between the flange plate 29 and the pump cover 14, in which case the accumulation of material required on the flange section 2 for the flange mounting surface of the pump cover 14 can be used for the installation of the pressure limiting valve 28.

LIST OF REFERENCE SIGNS

1 pump housing
2 flange section
4 screw housing section
6 pressure chamber
6*a* projecting chamber section
8 connecting bore
10 screw chamber
12 inlet bore
14 pump cover
16 through bore
18 screw shank
20 screw
22 rolling contact bearing
24 sealing section
26 helical section
27 outlet bore
28 pressure limiting valve
29 flange plate
30 valve bore
32 valve element
34 plunger tip
36 valve seat
38 preloading spring
40 adjusting screw
42 drain bore

The invention claimed is:

1. A screw pump, comprising:
a pump housing having a flange section on which the pump may be installed and a screw housing section;
an integrated pressure limiting valve; and
at least one screw having (i) a screw shank which extends through a pressure chamber in the flange section, and (ii) a working section which is located in the screw housing section,
wherein the pressure limiting valve is installed in the flange section of said pump housing,
wherein a sealing section is formed on the screw shank, said sealing section is in sealing/sliding engagement with the flange section at the entry to the pressure chamber so as to seal off the pressure chamber from the atmosphere.

2. The screw pump as claimed in claim 1, wherein:
the pressure chamber is formed in the flange section of the pump housing, and
the pressure limiting valve has a direct fluid connection to the pressure chamber.

3. The screw pump as claimed in claim 1, wherein the pressure limiting valve is connected to a fluid tank in order to relieve an excess pressure in the pressure chamber into the fluid tank.

4. The screw pump as claimed in claim 1, wherein: the flange section and the screw housing section are screwed, caulked or riveted together.

5. The screw pump as claimed in claim 1, wherein the pressure limiting valve is aligned substantially parallel to the at least one screw and is inserted into the flange section directly radially outwardly of the screw shank.

6. The screw pump as claimed in claim 1, wherein:
the pressure chamber is formed non-centrally with respect to the at least one screw, and
the pressure limiting valve opens into the section of the pressure chamber which projects further out radially in relation to the at least one screw.

7. The screw pump as claimed in claim 1, further comprising a flange plate which is formed on the flange section of the pump housing and surrounds the pressure chamber in the form of an annular disk.

8. The screw pump as claimed in claim 7, wherein the pressure limiting valve is inserted into the housing wall of the flange section in the region between the flange plate and the screw housing section.

* * * * *